United States Patent [19]

Tsybulevsky et al.

[11] 4,124,487

[45] Nov. 7, 1978

[54] PROCESS FOR REFORMING AND DEWAXING BY SELECTIVE HYDROCRACKING OF HYDROCARBON FRACTIONS

[76] Inventors: Albert M. Tsybulevsky, ulitsa Krasnykh partizan, 244, kv. 4, Krasnodar; Kapitolina P. Danilushkina, ulitsa Gafuri, 3, kv. 39, Kazan; Petr M. Pak, ulitsa Pushkina, 99, kv. 60, Krasnodarsky krai, poselok Afipsky, all of U.S.S.R.

[21] Appl. No.: 802,630

[22] Filed: Jun. 2, 1977

[51] Int. Cl.[2] ..... C10G 13/06; C10G 35/06; C07C 9/04; C01B 29/28

[52] U.S. Cl. ..... 208/111; 48/196 R; 208/15; 208/136; 252/455 Z; 260/676 R

[58] Field of Search ..... 208/111, 136; 48/196 R

[56] References Cited

U.S. PATENT DOCUMENTS

| | | | |
|---|---|---|---|
| 3,929,620 | 12/1975 | Parthasarathy et al. | 208/111 |
| 3,948,760 | 4/1976 | Gring | 208/111 |
| 3,956,104 | 5/1976 | Hilfman et al. | 208/111 |
| 4,040,944 | 8/1977 | Kelley et al. | 208/111 X |

*Primary Examiner*—Delbert E. Gantz
*Assistant Examiner*—G. E. Schmitkons
*Attorney, Agent, or Firm*—Lackenbach, Lilling & Siegel

[57] ABSTRACT

The process for selective hydrocracking of hydrocarbon fractions consists in that hydrocarbon fractions are contacted with hydrogen at a respective molar ratio of 1:2.5–20, a temperature of 280° – 520° C., and a pressure of 15 – 100 kgf/cm$^2$ on a zeolite catalyst with a pore size of 4.6 to 6.0 Å and containing 0.1 to 5 wt.% of metal of Group VIII of the periodic system, and a tervalent chromium cation with a minimum exchange capacity equal to 30 percent.

The herein-proposed process for selective hydrocracking of hydrocarbon fractions is capable of upgrading petroleum products accompanied by producing a synthetic substitute of natural gas.

3 Claims, No Drawings

PROCESS FOR REFORMING AND DEWAXING BY SELECTIVE HYDROCRACKING OF HYDROCARBON FRACTIONS

The present invention relates to processes for selective hydrocracking of hydrocarbon fractions.

Said hydrocarbon fractions (petroleum products) find widespread application.

For instance, light distillates of 30° to 200° C. boiling point ranges (gasolines) are used in the production of internal combustion fuels; distillates of 160° to 350° C. boiling point ranges are used in the production of jet and diesel engine fuels; heavier higher boiling distillates are used in the production of distillate fuel and lubricating oil. In order to upgrade petroleum products, i.e., improve the octane number of low-octane gasolines and reduce the viscosity and congelation point of diesel fuels and oils, n-paraffins should sometimes be removed. Selective hydrocracking is one of such processes which permits removing n-paraffins from petroleum products.

A number of prior-art processes for selective hydrocracking of hydrocarbon fractions are now in common practice, said processes being aimed at improving the characteristics of said fractions. There has been developed in the United States the process "Selectoforming" for selective hydrocracking of reformates in view of increasing their sensitivity (i.e., the difference between the magnitudes of the octane number as obtained from the research method and the motor-method test). The process has been introduced into industrial practice. All these processes consist in that hydrocarbon stock containing a considerable proportion of normal paraffins that affect the quality of petroleum products, are mixed with hydrogen at a respective molar ratio of 1:2–20. The aforesaid mixture is passed into a catalytic reactor, containing a zeolite catalyst that has pores of 4.6 to 6 Å in size and contains metals of Group VIII of the periodic system. The process runs at temperatures on the order of 280° to 520° C. and a pressure from 15 to 100 kgf/cm$^2$. Under such conditions normal paraffins are split largely into liquefied $C_3$–$C_4$ gases. The result is a gas-and-liquid reaction mixture which is then separated in a system of separators. The gas phase, containing mostly hydrogen and admixture of light hydrocarbon gases, is returned into the process cycle, while the liquid phase is subjected to stabilizaton in rectifying columns to separate a broad fraction of $C_1$–$C_4$ hydrocarbons. Said fraction, if necessary, can undergo further separation into particular hydrocarbons.

Another process for selective gasoline demethylation is carried out under conditions similar to those discussed above, on a zeolite catalyst of the type A, containing Ni or Co.

The processes of selective hydrocracking of hydrocarbon fractions are carried out only on zeolites featuring the properties of a molecular sieve and also high superficial acidity. As a result, destruction of normal paraffins occurs in every selective hydrocracking process according to the carbonium-ion mechanism with predominantly symmetrical breaks of large-size carbonium ions. Thus, hydrocarbon $C_3$–$C_5$ gases prove to be mainly the final gaseous cracking products. Apart from the above-described ionic hydrocarbon-splitting reactions occurring in the course of selective demethylation, the reaction of partial demethylation proceeds as well, which runs on the radical mode (1–2 methyl groups). The result is that methane occurs to be the gaseous reaction product, as well as hydrocarbon $C_2$–$C_4$ gases in the case of light naphtha distillates used as the charge stock. Use of heavy fractions in that process cannot produce the desired effect, since the reaction products are normal paraffins with a shortened carbon chain that are hard to remove. This renders impracticable any enhancement of the octane number in the latter case.

As stated hereinbefore, the reaction products resulting from the above-discussed processes for hydrocracking petroleum fractions, contain hydrocarbon $C_2$–$C_5$ gases.

At the present time synthetic substitutes of natural gas are in great demand, especially in areas devoid of sources of natural gas. Most diverse petroleum stock such as kerosene-gas-oil and gasoline fractions, as well as liquefied gases are used as a raw material for producing a synthetic substitute of natural gas. The process is carried out at special plants which require large capital investments to arrange.

None of the heretofore known processes for selective hydrocracking of hydrocarbon fractions are capable of upgrading the petroleum products under process, and converting normal paraffins removed from said petroleum fractions, into a synthetic substitute of natural gas.

It is therefore an essential object of the present invention to provide such a process for selective hydrocracking of hydrocarbon fractions that would enable not only upgrading the petroleum products under process but also converting normal paraffins removed therefrom into a synthetic substitute of natural gas.

In keeping with said and other objects the present invention resides in a process, whereby hydrocarbon fractions are contacted with hydrogen at a molar ratio of 1:2.5–20, respectively, a temperature of 280°–520° C. and a pressure of 15–100 kgf/cm$^2$ on a catalyst which is essentially zeolite featuring its pore sizes measuring 4.6 to 6.0 Å and containing metals of Group VIII of the periodic system, and wherein, according to the invention said catalyst contains a tervalent chromium cation having an exchange capacity of at least 30 percent with a 0.1–5 wt.% content of the metal of Group VIII of the periodic system.

Used as a catalyst base may be natural or synthetic zeolite (molecular sieves) with the pores sized 4.6 to 6 Å. Among said zeolites are, e.g., such as type A zeolite, erionite, mordenite, chabasite, offretite, hmalinite, etc. The principal feature of such catalysts consists in a definite limitation of pore size so as to allow normal paraffin molecules to penetrate inside the crystal lattice but prevent the molecules of the hydrocarbons of other classes from getting onto the catalyst's active surface. The selective hydrocracking catalyst contains a hydrogenating-dehydrogenating component, which may be the metals of Group VIII of the periodic system such as Pt, Pd, Ni; to provide the selectivity of the hydrocracking process spoken of hereinbefore. The metallic component should be located inside the zeolite cavities which is attained by coating the metal upon the zeolite by virtue of ion exchange with aqueous or organic solutions of the salts of metals belonging to Group VIII. However, the salts of many metals, when dissolving, are liable to form complexes that oversize the zeolite pore sizes and therefore cannot penetrate into the zeolite crystal lattice. Such being the case, it is better practice to effect ion exchange from molten salts or carry out zeolite synthesis immediately from mother liquors, containing the salts of the corresponding materials. The preferable metal content of the catalyst is within 0.1 to 5 wt.%. The catalyst hydrogenolyzing and hydrocracking activity rises with the metal content. However, with a metal content in excess of 5 wt.% a tendency to reduced zeolite selectivity is observed, this being due to the fact that the proportion of the metallic component arranged on the outside zeolite surface is increased.

Presence of tervalent chromium ions in the catalyst intensifies its activity and raises thermal stability, but in particular it promotes selectivity with respect to some reaction products, specifically, to methane-enriched ones.

It is common knowledge that hydrogenolysis is a reaction of hydrocarbons which proceeds at active metal centers of the catalysts and does not require acid centers which conversely promote the concurrent reaction of hydrocracking. Difficulties in preparing a catalyst for carrying out selective hydrogenolysis featuring molecular sieve selectivity with respect to normal paraffin hydrocarbons, reside in arranging and localizing the metallic catalyst component within the zeolite crystal cavities in a highly dispersed state. As a rule metallic crystals are liable to migrate under high-temperature conditions so as to form large agglomerates (sintering), arranged on the outside surface of the zeolite voids. To prevent the catalyst from agglomeration which results primarily in lost selectivity, the catalyst is doped with tervalent chromium cations which inhibit agglomeration. However, this substantially increases the action of acid-base centers of the catalyst and its activity in the carbonium-ion type reactions, the cracking reaction in this particular case. From the above discussion it would be expected that the catalyst will feature high molecular sieve selectivity and hydrocracking activity. But it has been found quite unexpectedly that adding chromium to the catalyst makes it possible to carry out selective hydrogenolysis of normal paraffin hydrocarbons with a predominant formation of methane.

The point is that the cations of tervalent chromium do in fact increase the acid-base activity of the catalyst and concurrently promote the hydrogenolyzing activity of the catalyst metallic centers so much that competition on the part of the cracking reaction becomes negligible.

The aforesaid process conditions, that is, a temperature of 280°–520° C., a pressure of 15–100 kgf/cm$^2$, and a molar ratio between the charge stock and hydrogen, equal to 1:2.5–20, prove to be optimum for carrying out the process of hydrocracking of hydrocarbon fractions. Specific optimum process conditions are selected depending on the kind of the charge stock used. In general, the higher the stock boiling range, the less severe the process conditions.

It is recommended that the exchange percentage of tervalent chromium in the catalyst be equal to at least 50.

With a view to imparting high mechanical strength to the catalyst, and in some cases to providing the required transfer-diffusion system of secondary pores, the zeolite catalyst, according to the invention also contains some binders taken in an amount of 15 to 80 wt.%, such as thermostable inorganic oxides, e.g., alumina, silica, zirconia taken either separately or in combination with one another, or also mineral mixtures of said oxides, e.g., montmorillonite, kaolinite, bentonite, etc.

A distinguishing feature of the catalyst is that it is not only selective with respect to the process stock but also is highly selective towards the reaction products. This feature made it possible to carry out the process of a catalytic denormalization of hydrocarbon fractions with the concurrent production of a synthetic substitute of natural gas. The latter fact, in turn, allows one in many cases to dispense with the necessity for special plants for producing synthetic substitutes of natural gas and thus reduce capital investments. One more advantageous feature of the proposed process resides in its versatility, i.e., the process is applicable for treating a broad range of hydrocarbon stock (from light naphtha to oil fractions) as distinct from the known processes practicable only with reference to definite types of charge stock. Fairly complete extraction of normal paraffins from hydrocarbon stock allows attaining high quality of the petroleum products being upgraded which makes the process favorably competitive with the known processes of the same kind. The process needs no special equipment to be carried out; it can be effected on such plants as, say, hydrofining, reforming, hydrocracking, and some others.

The process is technologically simple and is carried into effect as follows.

The process can proceed in reactors with fixed, moving-or fluidized-bed catalyst. The charge stock, i.e., hydrocarbon fractions, such as naphtha, straight-run gasoline, reformate, diesel fuels, etc., is mixed with hydrogen or a hydrogeneous gas and is pressure-fed to the heater. The reaction mixture is heated to a required temperature, whereupon it is passed to the reactor, containing the catalyst. It is in said reactor that selective hydrogenolysis of the stock-contained n-paraffins occurs on the catalyst proposed herein and under the aforesaid conditions, with methane as a predominant reaction gas. The product leaving the reactor, is allowed to cool and is fed to the separator to separate out the gas phase which is in fact a synthetic substitute of natural gas. The liquid reaction products flow from the separator to one or several stabilizer columns and a product of the required fractional composition is obtained.

The procedure for preparing the catalyst of selective hydrocracking is as follows.

The catalysts are prepared by conventional methods. Used as a base for catalysts are zeolites having pore sizes measuring 4.6 to 6.0 Å, in particular, the type A zeolite, erionite, mordenite, offretite, etc., in the alkali or alkaline earth form. The ion-exchange operation is carried out from solutions or melts of the salts of the corresponding metals. Thus, for instance, to prepare the chromium-exchange forms of synthetic zeolites of type A and erionite, use is made of chromium nitrate, acetate, etc. Before, being used in ion-exchange operations, the zeolite powder is washed with water to remove free alkali, then treated with 0.1–2.0 N solutions of the salts of the respective metals, the ratio between the substituent cation in the solution and sodium and potassium in the zeolite being 1–5:1 g/eg, respectively. The operation is repeated several times.

The aforesaid solutions are taken in a 5–10 fold excess amount with respect to the quantity of the zeolite stock. When salt melts are made use of for ion-exchange operations, once-through zeolite treatment is quite enough. The melt-to-zeolite ratio is selected to obey the above-stated gram-equivalent ratio between the cations in the melt and in the zeolite.

Next the end product is washed with water. A further operation consists in coating a metal of Group VIII upon the chromium-exchange form, for which purpose use in preferably made of nitrates, whereupon the exchange operation is carried out until a metal content of 0.1–5.0 wt.% in the finished catalyst is obtained. The thus-prepared catalyst is water-washed, dried at 100°–200° C. for 4–5 hours and shaped into pellets, globules, etc., measuring 3 × 4 mm, the shaping process occurring with or without a binder. Used as a binder can be pure inorganic thermostable oxides, such as aluminum semihydroxide, silica sol, zirconium dioxide, etc., or some mineral raw stock, e.g., montmorillonite, kaolinite, etc., taken in an amount of 15–80 wt.%. Reduction of the metal ions to the nullvalent state is carried out in a stream of hydrogen at 400°–500° C., space velocity of 1–5 $h^{-1}$ and pressure of 0–40 kgf/cm$^2$ within a 24-h period.

To promote understanding given below are some specific examples of the practical embodiment of the present invention.

EXAMPLE 1

In the process of selective hydrocracking, used as the charge stock is platforming raffinate having a boiling range within 62°–105° C. and the following composition:

| Nos | Description of component | Weight percentage |
|---|---|---|
| 11 1 | iso-pentane | 0.08 |
| 11 2 | n-pentane | 0.11 |
| 11 3 | 2,2-dimethylbutane | 0.26 |
| 11 4 | 2-methylpentane | 0.66 |
| 11 5 | 3-methylpentane | 6.18 |
| 11 6 | n-hexane | 12.9 |
| 11 7 | 2,2-dimethylpentane | 1.09 |
| 11 8 | methylcyclopentane | 4.07 |
| 11 9 | 2,4-dimethylpentane | 3.01 |
| 10 | 2,2,3-trimethylbutane | 0.21 |
| 11 | 3,3-dimethylpentane | 1.13 |
| 12 | cyclohexane | 0.57 |
| 13 | 2-methylhexane | 11.17 |
| 14 | 2,3-dimethylpentane | 5.60 |
| 15 | 3-methylhexane | 15.51 |
| 16 | 1,3-dimethylcyclopentane-cis | 0.86 |
| 17 | 1,3-dimethylcyclopentane-trans | 2.56 |
| 18 | 1,2-dimethylcyclopentane-cis | 1.19 |
| 19 | n-heptane | 15.23 |
| 20 | 2,2-dimethylhexane | 0.38 |
| 21 | 1,2-dimethylcyclopentane-trans | 0.50 |
| 22 | 2,5-dimethylhexane | 1.53 |
| 23 | 2,4-dimethylhexane | 1.29 |
| 24 | ethylcyclopentane | 0.72 |
| 25 | 3,3-dimethylhexane | 0.35 |
| 26 | toluene | 2.37 |
| 27 | 2,3-dimethylhexane | 0.73 |
| 28 | 2,2,3-trimethylpentane | 0.29 |
| 29 | 2-methylheptane | 2.37 |
| 30 | 4-methylheptane | 1.27 |
| 31 | 3-methylheptane | 3.36 |
| 32 | n-octane | 1.83 |

Then the charge stock is mixed with hydrogen at a molar ratio of 1:5, heated to 500° C. and fed to the reactor, containing the catalyst which is essentially the type A synthetic zeolite featuring a molar ratio of $SiO_2$:$Al_2O_3$ equal to 2:1 and containing 3.5 wt.% Ni, the exchange capacity of Na for the ions of tervalent chromium being 78 percent.

The pressure within the reactor is maintained at 40 kgf/cm$^2$, the feed space velocity being 1 $h^{-1}$.

Hydrocracking of platforming raffinate yields: gasoline-catalysate, 64.76 wt.% per stock, motor-method octane number, 72.0 (TEL-free); synthetic substitute of natural gas, 37.04 wt.% per stock, of the following composition: methane, 70 vol.%; ethane, 13.7 vol.%; propane, 7.7 vol.%; isobutane, 1.7 vol.%; n-butane, 4.1 vol.%; and hydrogen, 2.8 vol.%.

The catalyst is prepared as follows. The type A synthetic powdery zeolite featuring a molar ratio of silica and alumina equal to 2, taken in the sodium form, is charged into an ion-exchange column and is subjected to a thrice-repeated treatment with 2-n aqueous solution of chromium acetate at 40° C. The attainable exchange capacity of $Na^+$ for $Cr^{3+}$ equals 78 percent. The specimen is washed with distilled water and then with a nickel nitrate solution till a nickel content of 3.5 wt.% per finished catalyst, whereupon dried at 115° C. within 4 hours. The dried specimen is shaped into tablets measuring 3 × 4 mm, having preliminarily added kaolinite as a binder, in an amount of 22 wt.% with respect to the dried specimen. The catalyst is allowed to dry at 150°–200° within 4 hours, then the temperature is gradually raised to 400°–450° C., and the catalyst is reduced in a stream of hydrogen at a feed space velocity of 1–5 $h^{-1}$ and a pressure of 20 kgf/cm$^2$ for 24 hours.

EXAMPLE 2

Used as the charge stock is catalytic-reforming gasoline of the 85°–190° C. fraction and the motor-method octane number of 80.5 nn, with the use of the catalyst described in Example 1. Selective hydrocracking proceeds under the following conditions: temperature, 460° C.; pressure, 32 kgf/cm$^2$; stock feed space velocity, 2 $h^{-1}$; stock-hydrogen ratio, 1:10. The process proceeds with partial recirculation of the hydrogeneous gas.

As a result of selective hydrocracking effected, the octane number of the reformate rises to 87.2 nn. The yield of debutanized gasoline-catalysate, 86.4 wt.% per stock. Yield of the gas utilizable as a synthetic substitute of natural gas, 12.5 wt.%. Composition of the gas obtained: methane, 84.1 vol.%; ethane, 5.9 vol.%; propane, 3.3 vol.%; isobutane, 0.6 vol.%; n-butane, 1.4 vol.%; hydrogen, 4.7 vol.%.

EXAMPLE 3

Used as the charge stock is gas-oil with the boiling range of 180°–300° C. and specific gravity of 0.8690 at 20° C. The congelation point of the stock is 5.6° C.

The catalyst used is essentially erionite with a molar ratio of $SiO_2$:$Al_2O_3$ equal to 6, containing 5 wt.% Ni, the exchange capacity of tervalent chromium ions being 42 percent. The selective hydrocracking process conditions are as follows: temperature, 320° C.; pressure, 100 kgf/cm$^2$; feed space velocity, 0.8 $h^{-1}$; stock-hydrogen ratio, 1:10.

The yield of the product featuring its boiling point above 180° C. equals 81.6 wt.%. As a result of selective hydrocracking of n-paraffins the congelation point becomes as low as −10.4° C.

The yield of gaseous products, viz, a synthetic substitute of natural gas, is equal to 12.5 wt.% with a content of $C_3$–$C_4$ hydrocarbons therein ca. 6.2 vol.%.

The catalyst is prepared as follows. Synthetic powdery erionite taken in the potassium-sodium form, with the silica-to-alumina molar ratio equal to 6.0, is treated with molten chromium nitrate. The ion exchange capacity of chromium ions for univalent cations is 42 percent. Further operations are similar to those described in Example 1, with the sole exception that the specimen is washed with nickel nitrate solution till the nickel content of 5 wt.% as per finished catalyst.

What is claimed is:

1. A process for selective hydrocracking of hydrocarbon fractions, residing in that said hydrocarbon fractions are brought in contact with hydrogen at a respective ratio of 1:2.5–20, a temperature of 280°–520° C. and a pressure of 15–100 kgf/cm$^2$ on a zeolite catalyst with pore sizes measuring from 4.6 to 6.0 Å and containing 0.1 to 5 wt.% of a metal of Group VIII of the periodic system, and a tervalent chromium cation with a minimum exchange capacity equal to 30 percent.

2. A process as claimed in claim 1, wherein the catalyst contains the tervalent chromium cation having a minimum exchange capacity equal to 50 percent.

3. A process as claimed in claim 1, wherein the catalyst contains a binder, selected from the group of thermostable inorganic oxides and mineral mixtures of said oxides and taken in an amount of 15–80 wt.%.

* * * * *